US005148575A

United States Patent [19]

Clement

[11] Patent Number: 5,148,575

[45] Date of Patent: Sep. 22, 1992

[54] COMBING HEAD WITH LOWER NIPPER PLATE GUIDE ELEMENTS

[75] Inventor: Heinz Clement, Winterthur, Switzerland

[73] Assignee: Rieter Machine Works, Ltd., Winterthur, Switzerland

[21] Appl. No.: 673,013

[22] Filed: Mar. 21, 1991

[30] Foreign Application Priority Data

Mar. 23, 1990 [CH] Switzerland ..... 00983/90

[51] Int. Cl.[5] ..... D01G 19/16

[52] U.S. Cl. ..... 19/235; 19/215

[58] Field of Search ..... 19/115 R, 215, 216, 19/217, 218, 219, 220, 221, 223, 225, 233, 234, 235

[56] References Cited

U.S. PATENT DOCUMENTS

| | | | |
|---|---|---|---|
| 2,572,122 | 10/1951 | Dudley et al. | 19/116 |
| 2,831,216 | 4/1958 | Brusorio et al. | 19/218 |
| 2,986,779 | 6/1961 | Letterman | 19/221 |
| 3,103,041 | 9/1963 | Nydam | 19/225 |
| 4,993,122 | 2/1991 | Ackeret et al. | 19/225 |
| 5,044,048 | 9/1991 | Egerer | 19/216 |

FOREIGN PATENT DOCUMENTS

| | | |
|---|---|---|
| 394529 | 4/1964 | Japan . |
| 0351197 | 2/1961 | Switzerland . |
| 0123141 | 2/1919 | United Kingdom . |
| 0356810 | 10/1931 | United Kingdom . |

*Primary Examiner*—Werner H. Schroeder
*Assistant Examiner*—Michael A. Neas
*Attorney, Agent, or Firm*—Francis C. Hand

[57] ABSTRACT

The combing head has a pair of lateral guide elements mounted on the lower nipper part with each having a fiber guide surface disposed in front of the front edge of the lower nipper plate in order to laterally guide the fiber tuft extending from the lower nipper plate. The lateral guide elements are connected with a second pair of lateral guide elements on the lower nipper plate behind the front edge of the lower nipper plate. The second pair of guide elements also have fiber guide surfaces for guiding the lateral side edges of the fiber tuft. The pairs of guide elements each define a space therebetween of decreasing width in a perpendicular direction relative to the plane of the lower nipper plate.

9 Claims, 2 Drawing Sheets

COMBING HEAD WITH LOWER NIPPER PLATE GUIDE ELEMENTS

This invention relates to a combing head for a combing machine. More particularly, this invention relates to a nipper jaw for a combing machine.

As is known, combing heads used in textile combing machines are usually constructed with a pair of nipper jaws which are normally used to hold a fiber tuft when the jaws are in a closed state so that the fiber tuft can be combed out by a rotating circular comb. After combing, the nipper jaws are opened relative to each other so that the combed-out fiber tuft can be guided to a pair of detaching rollers which serve to join the end of the fiber tuft to a combed sliver fleece which has been previously formed, while at the same time tearing off the tuft from a wadding or lap in the nipper jaws.

As is also known, combed sliver fleeces which are produced by the known combing machines always have certain irregularities.

Accordingly, it is an object of the invention to obtain a uniform combed sliver fleece.

It is another object of the invention to provide an improved combing head for obtaining a uniform combed sliver fleece.

Briefly, the invention is directed to a combing head for a combing machine, wherein the head comprises a lower nipper part having a frame and a lower nipper plate supported on the frame as well as a top nipper plate moveably mounted relative to the lower nipper plate in order to press one edge of the top nipper plate against a front edge of the lower nipper plate. In accordance with the invention, a pair of lateral guide elements is mounted on the lower nipper part with each guide element having a fiber guide surface disposed in front of the front edge of the lower nipper plate and in facing relation to the other guide plate.

The lateral guide elements provide guide surfaces which are disposed in front of the front edge of the lower nipper plate and which serve to guide the side edges of a fiber tuft projecting from the nipper plates while the combing head is opened and the fiber tuft is conveyed to a pair of detaching rollers Thus, the side edges of the fiber tuft remain compact and have about the same thickness as the average area of the fiber tuft. This, in turn, leads to a combed fiber fleece which is more uniform, particularly, in the area of the side edges. At the same time, through the use of the lateral guide elements, the risk is reduced of laterally projecting fibers on the side edges of the fiber tuft which are not grasped by the detaching rollers from becoming deposited somewhere or other, thus, leading to disturbances, for example, to laps on the detaching roller.

In contradistinction, in known combing machines, it has been found that irregular side edges of the combed sliver fleece result because the side edges of the fiber tuft which are guided to the detaching rollers are not sufficiently compact Also, the side edges have been thinner than the average area of the fiber tuft and have laterally projecting fibers.

These and other objects and advantages of the invention will become more apparent from the following detailed description taken in conjunction with the accompanying drawings wherein.

Figure 1:
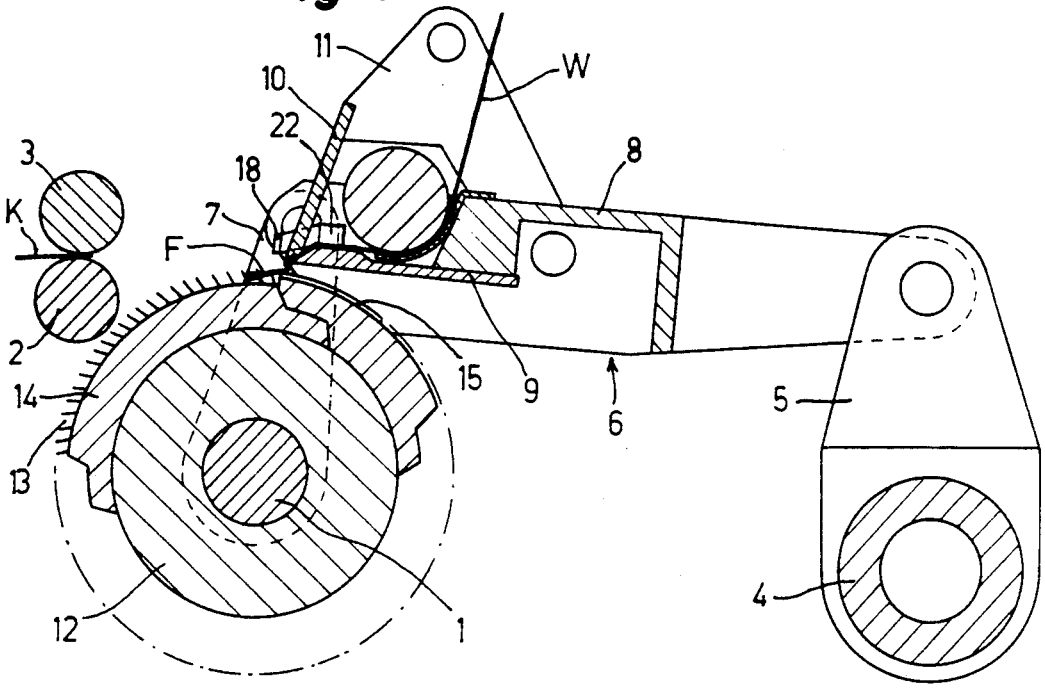
FIG. 1 illustrates a schematic vertical section through parts of a combing head of a combing machine constructed in accordance with the invention.

Referring to FIG. 1, the combing head, parts of which are represented in the drawings, contains a rotatable circular comb shaft 1, a pair of detaching rollers 2, 3 and a oscillatable nipper shaft 4, all of which are supported in a machine frame (not shown). The nipper shaft 4 carries a pair of crank arms 5 on the rear end of which a lower nipper part 6 is pivoted. The front end of the lower nipper part 6 is pivoted on a pair of front supports 7 which are supported to pivot on the axis of the circular comb shaft 1.

The lower nipper part 6 consists of a frame 8 and a lower nipper plate 9 supported by the frame 8.

A top nipper plate 10 operates in conjunction with the lower nipper plate 9 and is supported by a pair of arms 11 connected to swivel with the frame 8 so as to move relative to the bottom nipper plate 9 to press one edge of the top nipper plate 10 against a front edge of the lower nipper plate 9.

The continually rotating circular comb shaft 1 carries a roller body 12 in the usual way, on which a circular comb segment 14 is fastened which carries comb needles or comb clothing 13.

In FIG. 1, the nipper which is constituted by the lower nipper plate 9 and top plate 10 is represented in a retracted, closed position. Between the lower edge of the top nipper plate 10 and the front edge of the lower nipper plate 9, there is a fiber tuft F of the wadding (lap) waiting to be combed lying clamped in the nipper. This fiber tuft F has just been combed out by the comb needles or comb clothing 13 of the circular comb segment 14; the rear end in the direction of movement of the circular comb segment 14 has reached the fiber tuft F. (The direction of movement of the circular comb roller—counter-clockwise in FIG. 1—is indicated by the comb needles or comb clothing 13, which are inclined forwards in the direction of movement.)

Figure 2:
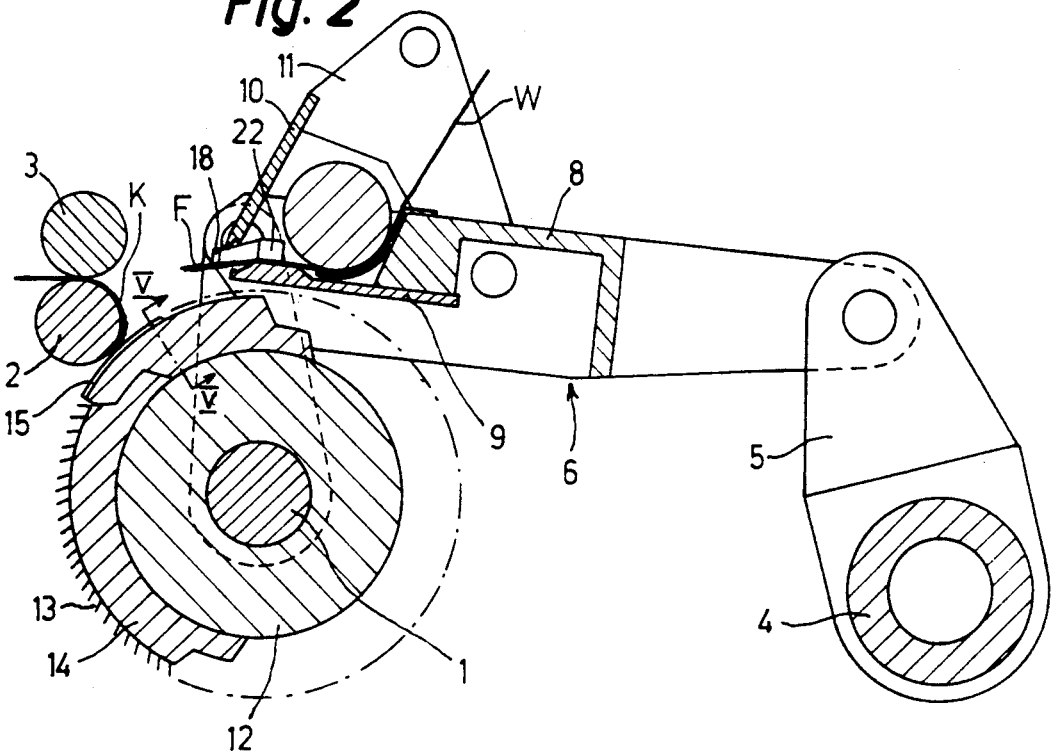
FIG. 2 illustrates a view similar to FIG. 1 of the combing head in an open position.

When the circular comb 1 turns further from the position according to FIG. 1, the rear end of the circular comb segment 14 leaves the fiber tuft F. Therewith, no fibers break off from the side edges of the fiber tuft F, as guide brackets 15 for the fiber tuft side edges are arranged on both sides of the roller body 12 following the rear end of the circular comb segment 14. The guide brackets 15 extend in the peripheral direction from the rear end of the circular comb segment 14 over an angle (seen from the axis of the circular comb shaft) of at least 20°, preferably at least 30°, so that they guide the side edges of the fiber tuft F until the nipper 6 leaves the retracted position according to FIG. 1, moves into the position shown in FIG. 2 and thereby opens. The radial height Of the guide brackets 15 is so selected that the radially outermost part of the guide brackets 15—these are their cylindrical outer peripheral surfaces with the form of the guide brackets shown - have approximately the same spacing from the axis of the roller body 12 as the points of the comb needles or comb clothing elements 13. The guide brackets 15 could be somewhat lower; their radially outermost parts should, however, expediently have at least the same spacing from the axis of the roller body 12 as the feet of the comb needles or comb clothing elements 13 or the outer peripheral surface of the circular comb segment 14.

Figure 3:
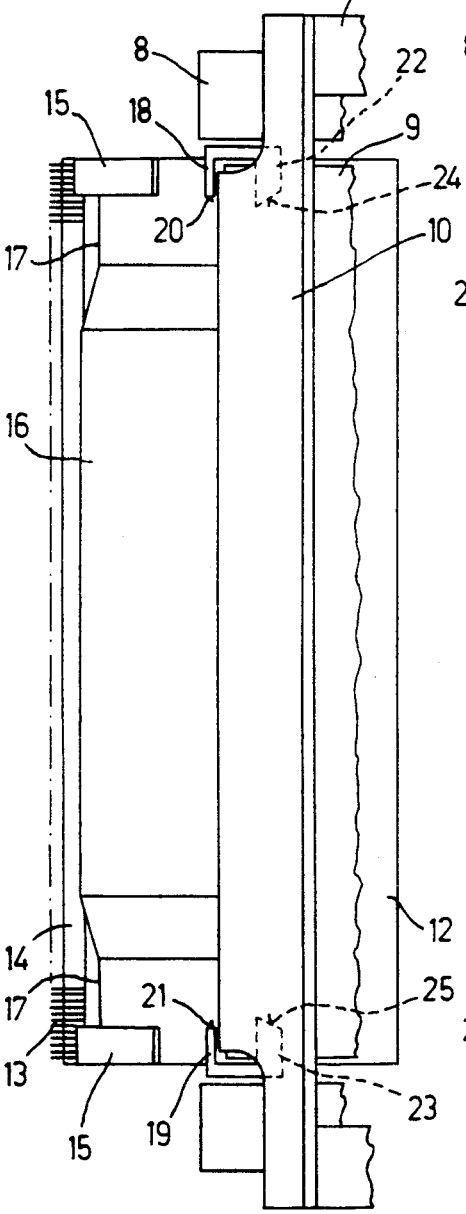
FIG. 3 illustrates a plan view of the combing machine of FIG. 1.

Referring to FIG. 3, a fiber supporting element 16 is also arranged on the roller body 12, as a connection to the rear end of the circular comb segment 14, which extends in the peripheral direction over an angle of at least 20°, preferably over an angle from 30° to 90°. The radially outermost parts of the fiber supporting segment 16 can have a spacing from the axis of the roller body 12 which lies in the same range previously described for the radially outermost parts of the guide brackets 15. However, there must then be a recess 17 between the radially outermost parts of the fiber supporting element 16 and the radially outermost parts of each of the two guide brackets 15, each of which extends in the peripheral direction. The recesses 17 receive the side edges of the fiber tuft F, so that these side edges can be guided by the side surfaces, as described, by the two guide brackets 15 turned towards each other.

Figure 5:
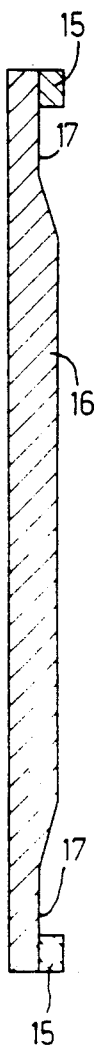
FIG. 5 illustrates a view taken on line from V–V of FIG. 2.

The guide brackets 15 can be fastened on the fiber supporting segment 16 as represented in FIG. 5. The guide brackets 15 can, however, also be formed as one piece with the fiber supporting segment 16.

The fiber supporting element 16 serves the purpose of supporting the fiber tuft F from beneath, after the rear end of the circular comb segment 14 has left the fiber tuft F. Through t his, the fiber tuft F is more compact and has fewer downwardly projecting fibers. At the same time, the fiber tuft F is lifted slightly and is placed in a more horizontal position. This is an advantage for the subsequent placing of the fiber tuft F on the end of a previously formed combed sliver fleece K, shown in FIG. 2, which is moved outwards through the reversed turning of the detaching rollers 2,3 from the clamping line itself. In the position according to FIG. 2, the fiber supporting element 16 also serves for the purpose of laying all the fibers of the end of the combed sliver fleece K downwards. Due to the fiber supporting element 16, the end of the combed sliver fleece K has less fibers projecting upwardly and the fiber tuft F has less fibers projecting downwardly. Accordingly, fewer fiber collisions occur with the placing of the fiber tuft F on the end of the combed sliver fleece K and a uniform agglutination can then be attained.

Figure 4:
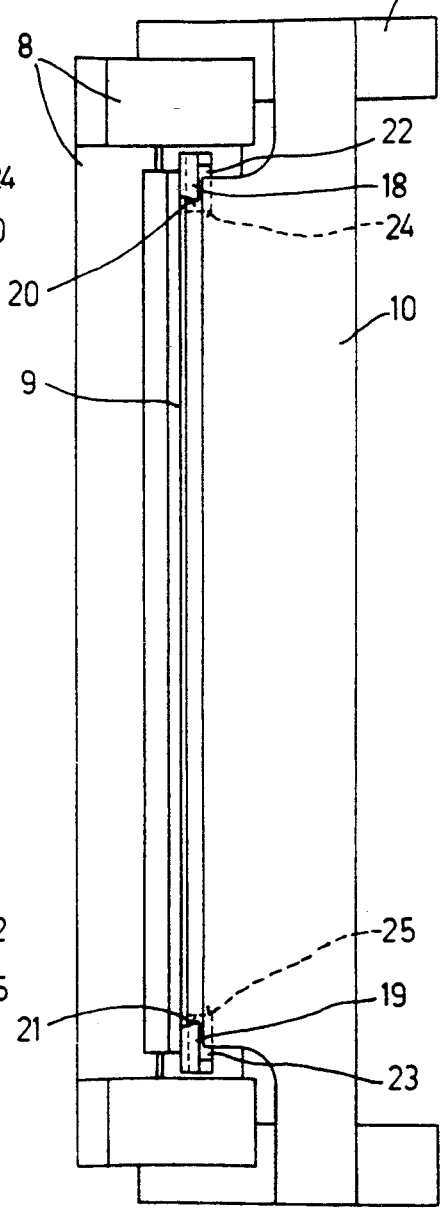
FIG. 4 illustrates a lateral view from the left of FIG. 3 without the circular comb.

The guide brackets 15 guide the side edges of the fiber tuft F, as described, until the nipper 6, 10 leaves the retracted position (FIG. 1) and opens. Subsequently, the guiding of the side edges of the fiber tuft is taken over by two lateral guide elements 18, 19 which are supported by the lower nipper part 6. These guide elements 18, 19 have fiber guide surfaces 20 and 21 in facing relation to each other with both disposed in front of the front edge of the lower nipper plate 9 (FIGS. 3 and 4). In the embodiment represented, the guide elements 18, 19 are supported by two additional lateral guide elements 22, 23, which are fastened to the lower nipper plate 9 behind the front edge of the lower nipper plate 9. The guide elements 18, 19 can be fastened as one piece with the appropriate additional guide element 22, 23.

The additional guide elements 22, 23 likewise have fiber guide surfaces 24, 25 turned towards each other. These guide the side edges of the wadding W, which runs to the front end of the lower nipper plate 9.

The fiber guide surfaces 20, 21 which guide the side edges of the fiber tuft F after the opening of the nipper 6, 10, have a spacing from each other in the direction of the width of the fiber tuft F, that is, measured parallel to the front edge of the lower nipper plate 9, which decreases from bottom to top in a vertical direction to a plane of the lower nipper plate 9. That is to say, the guide elements 20, 21 define a space therebetween of decreasing width in a perpendicular direction relative to a plane of the lower nipper plate 9. Through this, with the opening of the nipper 6, 10, when the fiber tuft F moves upwards, the side edges of the fiber tuft are pressed slightly upwards. The smallest spacing between the fiber guide surfaces 20, 21 is, however, somewhat larger, for example, by about 4 millimeters (mm), than the smallest spacing between the rear fiber guide surfaces 24, 25, so that the fiber tuft F can spread out slightly in relation to the wadding W.

The invention thus provides a combing head which is able to obtain a uniform combed sliver fleece due to the lateral guiding of the fiber tuft during transfer to the detaching rollers.

What is claimed is:

1. A combing head for a combing machine comprising a lower nipper part having a frame and a lower nipper plate supported on said frame;

a top nipper plate movably mounted relative to said bottom nipper plate to press one edge of said top nipper plate against a front edge of said lower nipper plate; and a first pair of lateral guide elements mounted on said lower nipper part, each said guide element having a fiber guide surface disposed in front of said front edge of said lower nipper plate and in facing relation to the other of said guide elements.

2. A combing head as set forth in claim 1 wherein said guide elements define a space therbetween of decreasing width in a perpendicular direction relative to a plane of said lower nipper plate.

3. A combing head as set forth in claim 1 which further comprises a second pair of lateral guide elements on said lower nipper plate behind said front edge of said lower nipper plate, each of said second pair of guide elements having a fiber guide surface facing the other of said second pair of guide elements.

4. A combing head as set forth in claim 3 wherein the smallest spacing of said first pair of guide elements from each other is larger than the smallest spacing between said second pair of guide elements.

5. A combing head as set forth in claim 3 wherein each of said second pair of guide elements is mounted on said lower nipper plate and each of said first pair of guide elements is mounted on a respective guide element of said second pair of guide elements.

6. A combing head for a combing machine comprising a lower nipper part having a lower nipper plate a top nipper plate movably mounted relative to said bottom nipper plate to press one edge of said top nipper plate against a front edge of said lower nipper plate; and a pair of guide elements mounted on said lower nipper part, each said guide element having a fiber guide surface disposed in front of said front edge of said lower nipper plate for laterally guiding a fiber tuft therebetween.

7. A combing head as set forth in claim 6 wherein said guide elements define a space therebetween of decreasing width in a perpendicular direction relative to a plane of said lower nipper plate.

8. A combing head as set forth in claim 6 which further comprises a second pair of lateral guide elements on said lower nipper plate behind said front edge of said lower nipper plate, each of said second pair of guide elements having a fiber guide surface facing the other of said second pair of guide elements.

9. A combing head as set forth in claim 8 wherein each of said second pair of guide elements is mounted on said lower nipper plate and each of said first pair of guide elements is mounted on a respective guide element of said second pair of guide elements.

* * * * *

UNITED STATES PATENT AND TRADEMARK OFFICE

CERTIFICATE OF CORRECTION

PATENT NO. : 5,148,575

DATED : September 22, 1992

INVENTOR(S) : HEINZ CLEMENT

It is certified that error appears in the above-identified patent and that said Letters Patent is hereby corrected as shown below:

Column 3, line 27 change "t his" to -this-

Signed and Sealed this

Fifth Day of October, 1993

*Attest:*

*Attesting Officer*

BRUCE LEHMAN

*Commissioner of Patents and Trademarks*